US006885829B2

(12) United States Patent
Braun et al.

(10) Patent No.: US 6,885,829 B2
(45) Date of Patent: Apr. 26, 2005

(54) METHOD AND ARRANGEMENT TO CONFIGURE AN ELECTROPHOTOGRAPHIC PRINTING SYSTEM OR COPYING SYSTEM

(75) Inventors: Peter Braun, Muehldorf (DE); Berthold Kathan, Munich (DE); Matthias Seeler, Munich (DE); Andreas Roehrl, Freising (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 10/694,493

(22) Filed: Oct. 27, 2003

(65) Prior Publication Data

US 2004/0120722 A1 Jun. 24, 2004

(30) Foreign Application Priority Data

Oct. 28, 2002 (DE) ..... 102 50 188

(51) Int. Cl.[7] ..... G03G 15/08
(52) U.S. Cl. ..... 399/8; 399/81
(58) Field of Search ..... 399/8, 9, 11, 81

(56) References Cited

U.S. PATENT DOCUMENTS 6,188,851 B1 2/2001 Eom
6,400,462 B1 * 6/2002 Hille ..... 358/1.14

FOREIGN PATENT DOCUMENTS

| | | |
|---|---|---|
| EP | 0 059 081 | 9/1982 |
| EP | 1 182 039 | 2/2002 |
| GB | 2 352 892 | 2/2001 |

* cited by examiner

*Primary Examiner*—Quana Grainger
(74) *Attorney, Agent, or Firm*—Schiff Hardin LLP

(57) ABSTRACT

In a method and a system to configure an electrophotographic printing or copying system, a first data set and at least a second data set are stored in a databank. The first data set comprises at least a value of a first default value and the second data set comprises at least the value of a second default value. A first program element reads out the value of the first default value and the value of the second default value from the databank with the aid of databank interrogation commands. Data with the value of the first default value and with the value of the second default value are transmitted to a first data processing system of an operating unit of the printing or copying system, whereby the data are supplied to a second program element executed by the first data processing system. With aid of a second program element, the data are transmitted via a data connection from the first data processing system to a second data processing system of the printing or copying system.

25 Claims, 6 Drawing Sheets

METHOD AND ARRANGEMENT TO CONFIGURE AN ELECTROPHOTOGRAPHIC PRINTING SYSTEM OR COPYING SYSTEM

BACKGROUND OF THE INVENTION

The invention concerns a method and an arrangement to configure an electrophotographic printing or copying system. The printing or copying system comprises a data processing system that is connected with a first data processing system of an operating unit via a data connection. Via this data connection, data of default values can be transmitted between the first data processing system and a second data processing system. Furthermore, the invention concerns a method, an arrangement, and a graphical user interface for simple operation, maintenance and/or configuration of an electrophotographic printing or copying system.

In known electrophotographic printing or copying systems, default values for a first configuration of the printing or copying system are transmitted together with the program data to individual control units of the printing or copying system. Given control units in which the default values can not be stored together with the program data, the configuration of the printing system is implemented with the aid of an operating unit, i.e. the corresponding default values are input by a service technician with the aid of the operating unit.

If, for example, the default values to be preset are changed due to modified assembly groups, in known printers or copiers the program data must itself be changed when only a change of the preset default values should occur. Alternatively, the default values can be changed via the operating unit. Should the set values be reset to basic default values in known printing or copying systems, then either the program data must by newly transmitted to the control units of the printing or copying system, and/or the set values of the operating unit are changed to the original default values. In general, the transfer of the program data and the setting of default values, at least the default values of system parameters, occurs by qualified service technicians. The implementation of the default values is thus very time consuming and expensive.

Furthermore, in known printing or copying systems, it is possible with the aid of a communication interface to access a part of the default values and the program data of the printing or copying system. For this, the printer has been connected (for example by an operating personnel) with a telephone network via a modem. With the aid of a maintenance computer, a service technician then establishes a connection to the printing or copying system via a modem of the maintenance computer and the telephone network. However, during the change of the default values, no print jobs can be processed, whereby stop times of the printing or copying system occur.

An electronic printing system is known from the patent U.S. Pat. No. 5,077,795 in which the security of user data and user programs is ensured with the aid of a user profile for each user. The user profiles are administrated by a security administrator onsite or from a remote location.

SUMMARY OF THE INVENTION

It is an object of the invention to specify a method to configure an electrophotographic printing or copying system in which predetermined default values are supplied in a simple manner to a storage region of the printer.

Furthermore, a method and an arrangement are to be specified via which the operation, maintenance and/or configuration of an electrophotographic printing or copying system is possible in a simple manner.

In a method and system for simple operation, maintenance, or configuration of an electrophotographic or copying system, with aid of an operating unit a graphical user interface is output with at least one first graphical representation of the printer or copying system. A displayed assembly group of the printing or copying system is selected with aid of the first graphical representation. Via said selected displayed assembly group, at least one item of information about the selected assembly group is output with aid of the graphical user interface.

Also, in a method and system for configuring an electrophotographic printing or copying system, a first dataset and at least one second dataset stored in a data bank are provided, whereby the first dataset comprises at least a value of a first default value and a second dataset comprising at least a value of a second default value. With aid of a first program element, reading out the value of the first default value and the value of the second default value from the data bank with data bank interrogation commands. Data with the value of the first default value and with the value of the second default value are transmitted to a first data processing system of an operating unit of the printing or copying system whereby the data are supplied to a second program element executed via the first data processing system. The data are transmitted to a second data a processing system of the printing or copying system via a data connection with aid of the second program element. The data are transmitted to the second program element with aid of a platform-independent second interface.

DESCRIPTION OF THE PREFERRED EMBODIMENTS

Figure 1:
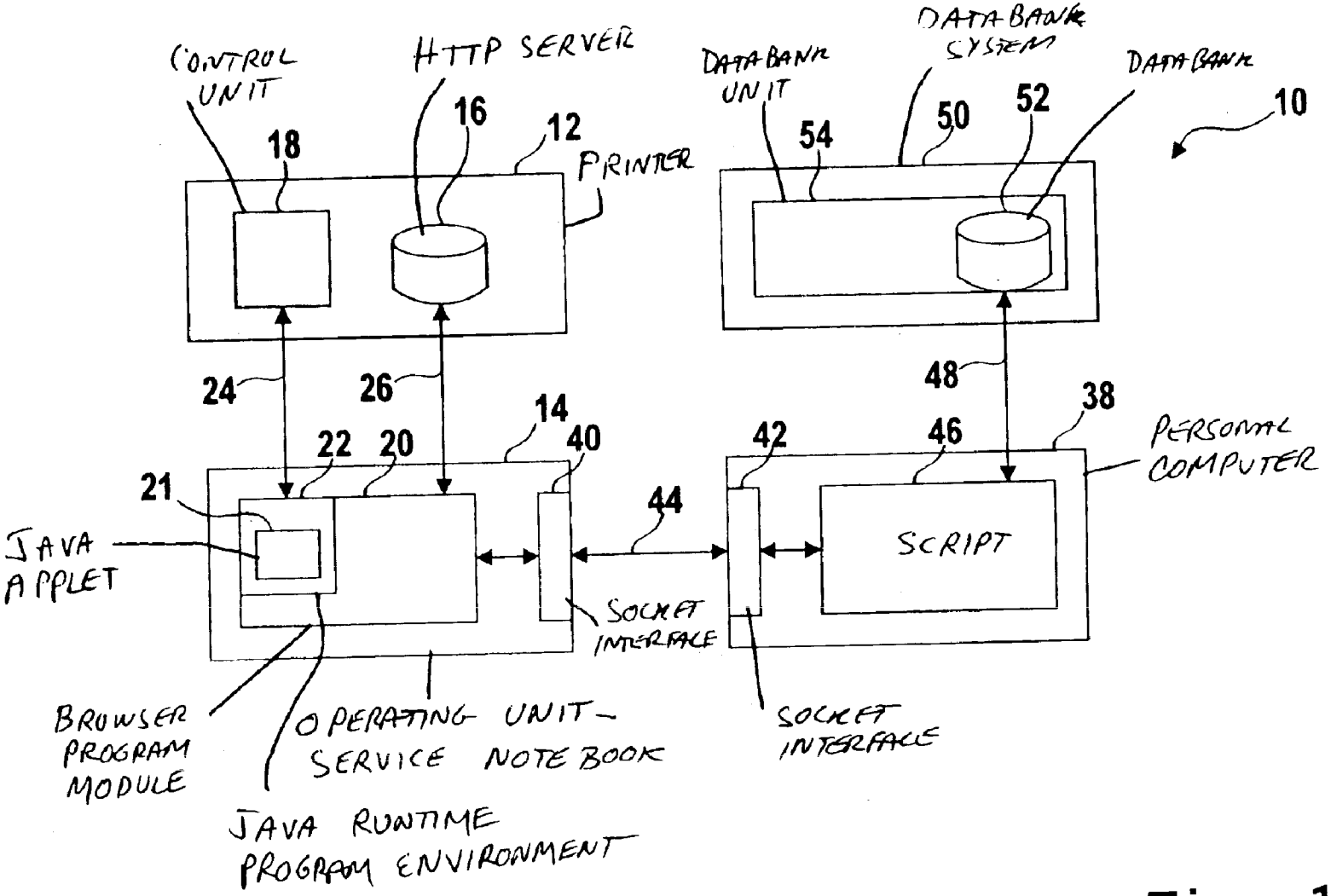
FIG. 1 illustrates a block diagram of a system to configure an electrophotographic printer according to a first exemplary embodiment.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Via the method, default values stored in a databank can be read out of the databank in a simple manner and transmitted to the printer. The transmission of the default values to the printer occurs preferably with the aid of the existing communication paths between the operating unit and the printer. With the aid of the first program element, all default values preset in the printer can be very simply and specifically read out from the databank. Should the value of the first and/or second default value be changed, for example due to a new assembly group of the printing or copying system, the value of the first and/or second default value is thus changed in the databank, and the method is repeated.

The method can also be repeated when the print quality of the printing or copying system is poor and it can not be determined with reasonable time-expenditure which default value is not correctly set. The values of the default values can thereby be newly transmitted to the printer, whereby the basic settings of the printer system are again produced. Via this inventive method, start-up times in the first start-up of the printing or copying system are thus saved by significant amounts, and times for error searches can be drastically reduced, at least in individual cases.

A second aspect concerns an arrangement to configure an electrophotographic printing or copying system. A first data set and at least one second data set are stored in a databank. The first data set comprises at least the value of a first default value, and the second data set comprises at least the value of a second default value. The arrangement comprises a first program element with databank interrogation commands, given the processing of which the value of the first default value and the value of the second default value are read out from the databank. The first data processing system processes a second program module to which the data are supplied via a data interface. Furthermore, a data connection is provided via which the data are transmitted with the aid of a second program element from the first data processing system to a second data processing system of the printing or copying system.

Via this arrangement, it is achieved that the effort to preset default values in a printing or copying system is possible in a relatively simple manner. Furthermore, the preset default values can very simply be used to preset the default values of printing or copying systems which are substantially identical in construction. In particular in the first start-up of printing or copying systems substantially identical in construction, the effort to preset the default values is significantly reduced by this arrangement. Furthermore, only data of default values, and no program data, are transmitted to the printing or copying system.

A third aspect concerns a method to simply operate, maintain and/or configure an electrophotographic printing or copying system. With the aid of an operating unit, a graphical user interface with at least one graphic representation of the printing or copying system is output. A displayed assembly group of the printing or copying system is selected with the aid of the graphic representation. Via this selection, at least one item of information is output to the selected assembly group with the aid of the graphical user interface.

Via this method, it is achieved that a clear operation, maintenance and/or configuration of the printing or copying system is possible since, via simple selection of an assembly group in the graphical display, further information about this assembly group, in particular measurement values, error data, default parameters and/or a further graphical display are output to operating personnel. Orientation times for operation, configuration and maintenance of the printing or copying system can thereby be significantly reduced. Furthermore, an intuitive operation, maintenance and configuration of the printing or copying system is possible via such an operating concept, for which the method forms the basis.

A fourth aspect concerns an arrangement for simple operation, maintenance and/or configuration of an electrophotographic printing or copying system. In this arrangement, an operating unit is connected via a data line with the printing or copying system. A graphical user interface is output on a display unit of the operating unit, whereby the graphical user interface comprises at least one first graphical representation of the printing or copying system. With the aid of the graphical user interface, an assembly group of the printing or copying system comprised in the graphical representation can be selected. Via this selection, at least information that concerns the assembly group can be output.

Via this arrangement, a simple operation, maintenance and/or configuration of the electrophotographic printing or copying system is possible. Via simple selection of an assembly group via the graphical user interface, information about this assembly group is output. In particular given an error state of the printing or copying system, the discovery of the cause of the error is thus possible in a simple manner, primarily when the assembly group is identified in the graphical representation given an error state. A simple and quick intuitive operation of the graphical user interface can also be achieved without copious training.

A fifth aspect concerns a graphical user interface for simple operation, maintenance and/or configuration of an electrophotographic printing or copying system. The graphical user interface has at least one first section in which a graphical representation of the printing or copying system can be output. With the aid of the graphical representation, an assembly group of the printing or copying system can be selected. Via this selection, at least one item of information can be output that concerns this assembly group.

With the aid of such a graphical user interface, a simple intuitive operation of the printing or copying system is possible. Long orientation times for secure operation, configuration and/or maintenance of the printing or copying system are not mandatory.

Reference is made in the following to the preferred exemplary embodiments shown in the drawings that are specified using specific terminology. However, it is to be noted that the scope of protection of the invention should not thereby be limited, since such changes and further modifications to the shown devices and/or the method, as well as such further applications of the invention as they are shown therein, are viewed as typical present or future expert knowledge of competent average man skilled in the art.

A block diagram of a system 10 to configure a printer is shown in FIG. 1. The printer 12 comprises an HTTP server 16 that comprises hypertexts (what are known as HTML documents) and program elements (what are known as JAVA applets). The hypertexts and the JAVA applets can be transmitted via a network connection 26 to an operating unit 14. In the present exemplary embodiment, the operating unit 14 is a service notebook. The service notebook 14 executes a program browser module 20, whereby the browser program module 20 comprises a JAVA runtime program environment 22, what is known as a JAVA runtime environment. The JAVA runtime program environment executes a signed JAVA applet 21 transmitted from the HTTP server 16. Alternatively to the signed JAVA applet 21, an active program element or a JAVA application can also be executed by the operating unit 14. With the aid of a remote method invocation communication 24 with the JAVA runtime program environment upon execution of the signed JAVA applet 21, a data communication occurs between the program environment 22 and a control unit 18 of the printer 12 that comprises at least one parameter storage. Default values of the printer 12, as well as measurement values, error states and operating states of the printer 12, are stored in the parameter storage. The JAVA applet 12 has access to the data in the parameter storage of the control unit 18 via the RMI communication 24. The access comprises both write and read accesses. With the aid of the read accesses, data are read out from the parameter storage, and with the aid of the write accesses new data are written in the parameter storage, for example data with changed setting data. The network connection 26 and the RMI communication 24 are preferably respectively realized via a data line as a point-to-point connection with different network protocols, whereby the data line is provided by a data network.

The system 10 comprises a databank system 50 with a databank 52 in a data bank unit 54. The databank system 50 is located on a web server of the printer manufacturer. Furthermore, the system 10 comprises a personal computer 38, via which a script 46 is executed. The script 46 comprises databank interrogation commands as well as parameters to select and query information from data sets stored in the databank 52. The data read out from the databank 52 with the aid of the script 46 are transmitted by the script 46 to a socket interface 42 of the personal computer 38. Such a socket interface 42 is the logical end point of a connection that has been established with the aid of a network protocol, for example TCP or UDP. Sockets 42 possess an identification that is also designated as a port or a port number. Such a socket interface 42 can be used in a simple manner for data transmission by program modules, such as the script 46 and the JAVA applet 21 or, respectively, the browser program module 20, upon their execution.

The script 46 is preferably a JAVA script and has been created in a suitable script language. Upon execution of the script 46, SQL instructions are generated that are transmitted to the databank via the network connection 48 Alternatively, the SQL instructions are comprised in the script 46. The SQL instructions serve to manipulate (i.e. change) and to query data structures and data sets in larger databanks. The service notebook 14 comprises a socket interface 40. The signed JAVA applet 21 can receive the data required by the script 46 via the socket interface 40. The JAVA applet 21 transmits these received default values to the data storage of the control unit 18 with the aid of the RMI communication 24. This data storage is preferably a management information base (MIB) of the printer 12. The default values are then supplied with the aid of SNMP commands of the management information base. The signal vectors are thereby transmitted to the control unit 18 of the printer 12 with the aid of the RMI communication. In the control unit 18, SNMP commands are generated by which the transmitted default values are transferred as parameters.

The generated SNMP commands are implemented in the control unit 18, whereby default values comprised in the SNMP commands are written in the management information base of the control unit 18. Via this system 10, all default values and further data to configure the printer 12 can thus be stored in the databank 52, read out in a simple manner with the aid of the script 46, and transmitted to the printer 12. Should a plurality of printers identical in construction be parameterized, for example given the first start-up of these printers, after the transmission of all default values from the databank 52 to the printer 12 the data line for the connections 24 and 26 between the service notebook 14 and the printer 12 is separated, and a further printer is connected with the service notebook 14 via the data line for the connections 24 and 26. The script 46 is subsequently repeatedly executed, whereby the default values and the further data read out from the data base or bank 52 are stored in a region of the control unit of the further printer, as already specified for printer 12.

In other exemplary embodiments, a PHP script is used in place of the JAVA script. The JAVA script and/or the PHP script are preferably likewise stored in a region of the databank 52. Via the network connection 48, the personal computer 38 can then preferably be connected with the databank system 50 via the internet. Alternatively, the network connection 48 can also be a point-to-point connection via a public telephone network between the personal computer 38 and the databank system 50. It is thereby possible that a service technician onsite at the customer can also access default values and further data stored in the databank 52 and, with the aid of a script 46, transmit in a simple manner the default values and data stored in the databank 52 to the printer 12.

In other exemplary embodiments, the service notebook 14 and the personal computer 38 are located in a service center of the printer manufacturer. The personal computer 38 is connected with the databank system 50 via an internal data network, for example a local area network (LAN), whereby the personal computer 38 has access to the databank 52 via this LAN. The connection between service notebook 14 and printer 12 is realized with the aid of LAN modems via a point-to-point connection, whereby both the RMI communication 24 and the data connection 26 occur substantially parallel to one another with the aid of the point-to-point connection.

In one preferred embodiment, all measurement values and default values can be read out from the parameter storage of the control unit 18 with the aid of the JAVA applet 21 and transmitted to the socket interface 42 via the socket interface 40, whereby with the aid of the personal computer 38 these data are then transmitted via SQL instructions to the databank 52. The data transmission between the personal computer 38 and the service notebook 14 occurs very simply via the socket interfaces 40, 42 with the aid of the program modules 46 and 21 via specification of the port number of the socket interface 42. Further program points do not have to be implemented via the JAVA applet, the JAVA runtime program environment 22 or via the browser program module 20.

The signed JAVA applet 21 is preferably a program element to diagnose the printer 12. This diagnosis program element 21 then has access to all default values and parameters of the printer 12. The program element 21 is furthermore used for operation, maintenance and/or configuration of the printer 12 via a graphical user interface of the service notebook 14. The RMI communication 24 between the service notebook 14 and the control unit 18 of the printer 12 serves both to transmit the default values and data that are read out from the databank 52 and for data transmission between the program element 21 and the control unit 18 to diagnose, maintain, and operate the printer 12 with the aid of the graphical user interface of the service notebook 14.

The personal computer 38 possesses a corresponding program environment to execute the script 46. With the aid of the instruction "Create Socket" (Port 5999) comprised in the script 46, a communication from the socket interface 42 of the personal computer 38 to the socket interface 40 of the service notebook 14 is established, whereby the socket interface 40 has the port number 5999. With a subsequent instruction "sendSOCKET(<data >)", data (that, for example, have been read out from the databank 52) are transmitted to the socket interface 40. With the instruction "RecvSOCKET", data are requested by the JAVA applet 21. With the instruction "closeSOCKET(Port 5999)", the data connection 44 to the socket interface 40 is broken. Depending on the script language, further and equivalent instructions are available.

It is most notably achieved via the implementation of the socket interfaces 40 and 42 that a communication is possible in a simple manner between the script 46 and the JAVA applet 21 upon execution of these program elements. In contrast to program codes from high level languages, the script 46 is very simple to create. For this, JAVA applets 21 are suitable to be executed with a JAVA runtime program environment 22, with the aid of a browser program module 20. With the help of the browser program module 20, a surface to output a graphical user interface is provided. All display data and data to generate the graphical user interface with the aid of the browser program module 20 are transmitted by the HTTP server 16 of the printer 12 to the service notebook 14. The service notebook 14 thus does not have to be provided with special software for operation, maintenance and/or configuration of the printer 12.

Figure 2:
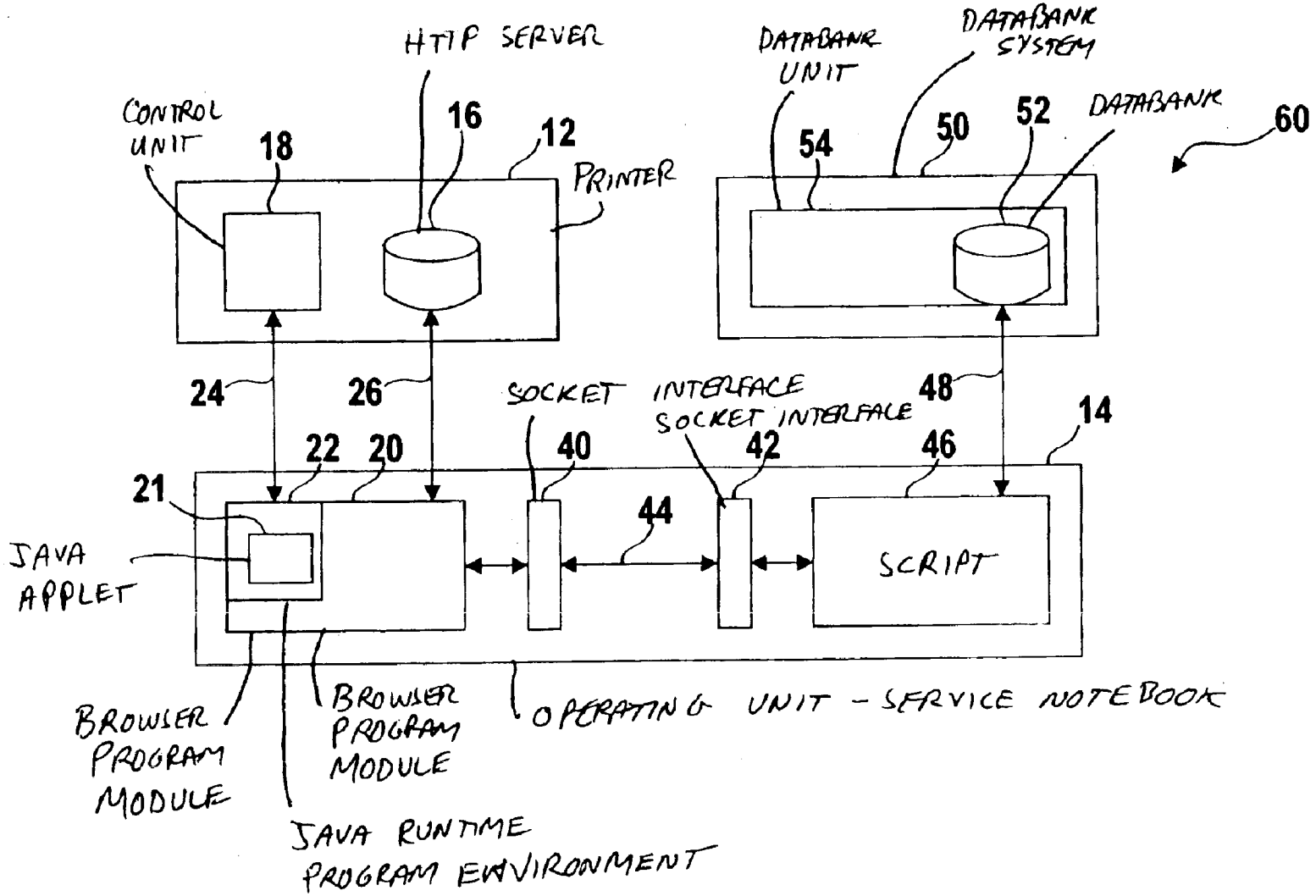
FIG. 2 a block diagram of a system to configure an electrophotographic printer according to a second exemplary embodiment of the invention.

A block diagram of a system 60 to configure an electrophotographic printer similar to the system 10 according to FIG. 1 is shown in FIG. 2. In contrast to the system 10 according to FIG. 1, the socket interface 40 and the socket interface 42 are comprised in the service notebook 14. Also as in the system 10 according to FIG. 1, the service notebook 14 executes the browser program module 20 that comprises a JAVA runtime program environment 22. The JAVA applet 21 is executed with the aid of the browser program module 20. Parallel to this (for example in a multi-tasking operation), the script 46 is executed by the service notebook 14.

The communication between the script 46 and the JAVA applet 21 occurs in the service notebook 14 via the socket interfaces 40 and 21 in the same manner as in the separate execution of the script 46 in the personal computer 38 according to FIG. 1. In the service notebook in the arrangement according to FIG. 2, A communication between the script 46 and the JAVA applet 21 is possible in a very simple manner via the socket interfaces 40 and 42. The data are preferably transmitted between the script 40 and the JAVA applet 21 with the aid of strings in which the information and data to be transmitted are comprised. A simple transmission of the data between the program elements 42 and 21 is thereby possible via the socket interfaces 40 and 42.

Figure 3:
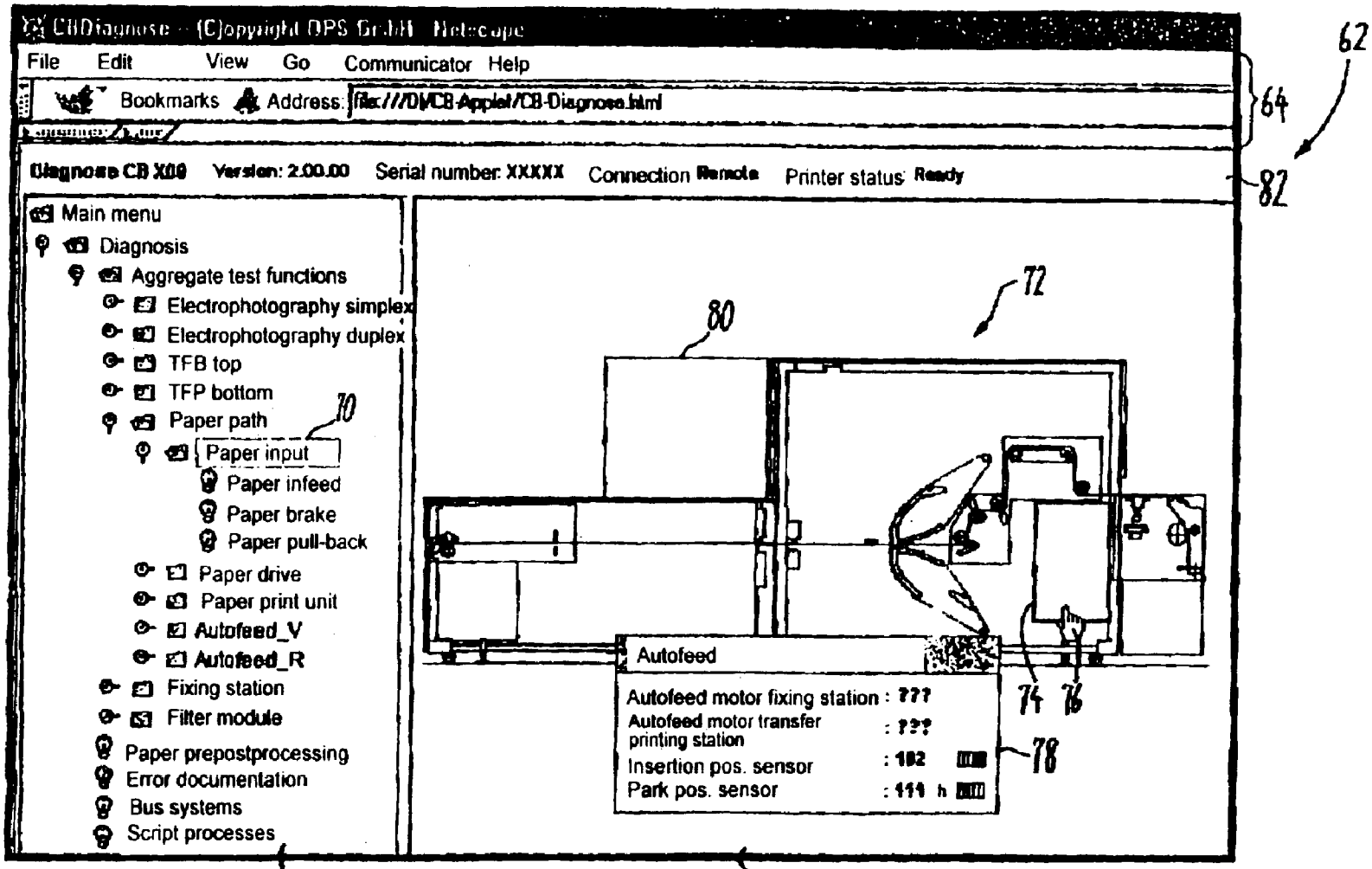
FIG. 3 illustrates a graphical user interface with a side view of a printer.

A graphical user interface 62 is shown in FIG. 3. The graphical user interface 62 is, for example, output on a display unit of the service notebook 14 and a display unit of an operating unit. In a first section 64, the graphical user interface 62 comprises a toolbar and menu bar to operate the browser program module 22. The browser program module 20 used to output the graphical user interface 62 according to FIG. 3 is a browser program module of the company Netscape. In a second section 66 of the graphical user interface 62, a menu with a menu tree and a plurality of menu items is shown, whereby with the aid of the menu items a user interface can be selected that can be displayed in a third section 68 of the graphical user interface 62. In the menu, the menu item 70 "Paper input" was selected, whereby in the section 68 a graphical representation 72 of the printer 12 is shown with elements that concern the paper course of the printer. With the aid of a marking frame 74, a region of the printer is indicated in which, for example, an error has occurred.

With the aid of what is known as a cursor 76 that can be positioned on the marking frame 74 with the help of a pointing device (such as, for example, a computer mouse or a touchscreen), after successful positioning and activation, information is output onto a display field 78 about operating states of a paper feed motor of a fixing station, a paper feed motor of a transfer printing unit, and sensor signals of an insertion position sensor and a park position sensor. Operating personnel, for example a service technician, thus receive detailed information about the operating state and measurement data that concern the paper input unit.

If, with the aid of the cursor 76, the operating personnel selects another assembly group (such as, for example, the assembly group 80) in which no error state has occurred, corresponding measurement values of sensors and operating states of actuators are also displayed for this assembly group 80. Furthermore, the information then displayed can comprise measurement values, value ranges and default values, as well as help texts to explain the displayed information. In an output field 82 of the graphical user interface 67, status information (such as the name of the printer 12, the version number, the serial number, the connection type between operating unit and printer 12, and the current printer status) is shown.

Figure 4:
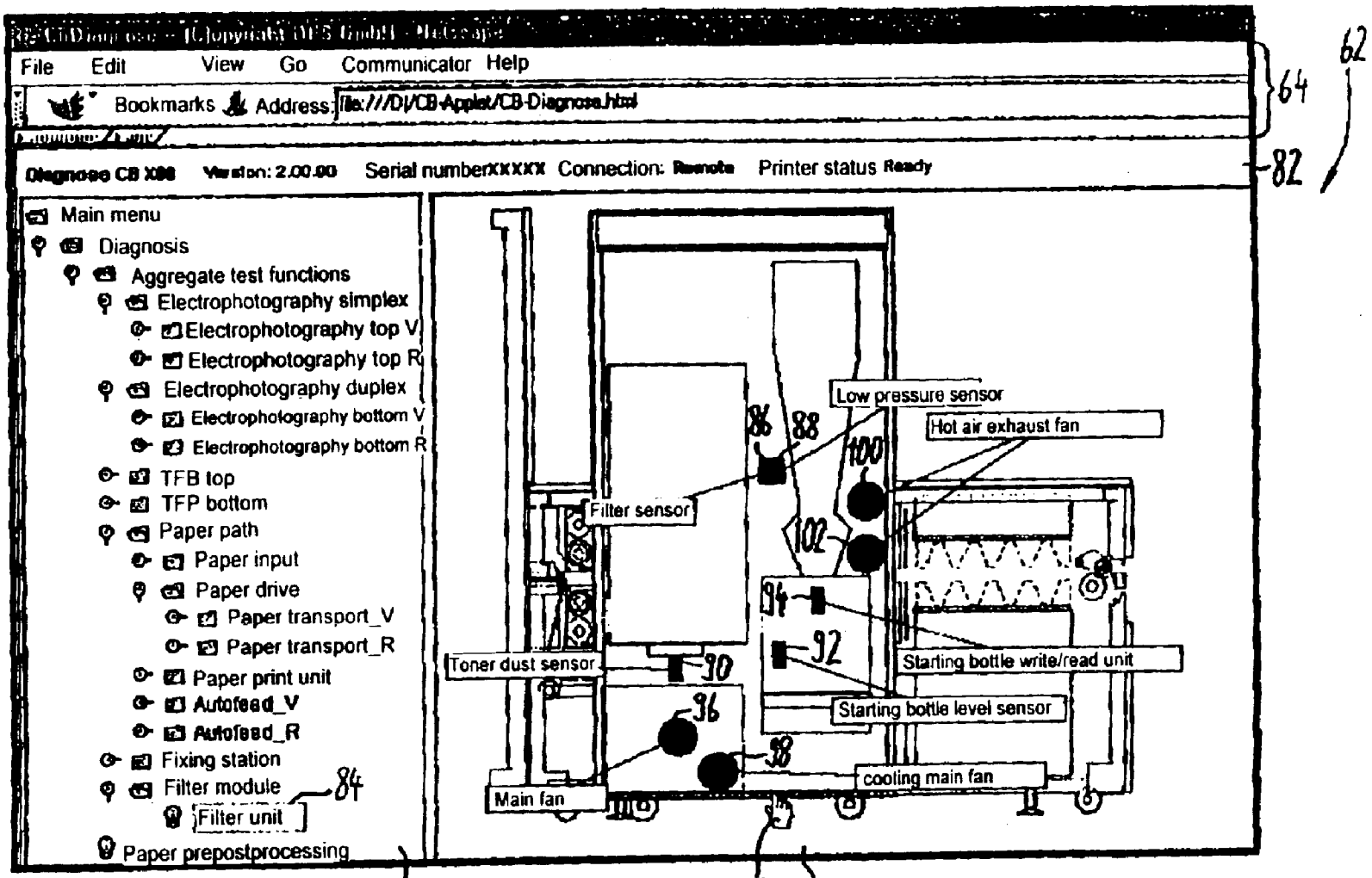
FIG. 4 shows the graphical user interface according to FIG. 3 with a detailed view of a selected assembly group.

The graphical user interface according to FIG. 3 is shown in FIG. 4, whereby in the section 68 a user interface is shown with a graphical representation of a filter unit of the printer 12. This user interface was output in the third section 68 of the graphical user interface 62 after selection and activation of the assembly group 80 shown in FIG. 3 with the aid of the pointing device 76. Via this selection, the menu item 84 is indicated as selected in the menu 66. The user interface shown in the section 68 can alternatively be selected via the menu item 84, without requiring that the region of the modular unit 80 in FIG. 3 be selected with the aid of the cursor 76. The graphical representation of the filter unit 80 comprises in particular graphically emphasized sensors and actuators whose functional efficiency are significant for the function of the filter unit. Both the sensors and the actuators are thereby displayed in a green color as long as no alarm or error state has occurred.

If, for example, a measurement value is at an acceptable measurement range limit, the sensor is shown in a yellow color. If the measurement value of the sensor has left the acceptable range, the sensor is shown in a red color, via which the error state is graphically illustrated. If an error state is determined at an actuator by a control unit of the printer 12, the respective actuator is thus displayed in a red color. With the help of the pointing device, a sensor or actuator can be selected, whereby in a display field further information are output about measurement values, measurement ranges and operating states of the sensor and/or actuator, as well as, if needed, an error message generated by the printer controller. The graphical representation 84 of the filter unit comprises a filter sensor 86, a low pressure sensor 88, a toner dust sensor, a level sensor 92, a write/read unit for data media comprised of a toner bottle, as well as a main fan 96, a fan 98 to cool the main fan 96, and two hot air exhaust fans 100, 102.

The graphical representation 84 of the filter unit according to FIG. 4 is thus a detailed representation of the modular unit 80 according to FIG. 3. Via the automatic display of the detailed representation 84 of the filter unit via selection of the modular unit 80 in the section 68 according to FIG. 3, operating personnel can quickly and precisely, in a very simple manner, select a modular unit whose default values and operating states should be presented and checked.

The graphical representations are preferably hierarchically organized such that further graphical representations with detailed views of the printer 12 (such as, for example, the detailed view 84) can be selected via a graphical representation 72 of an overall view of the printer as shown in FIG. 3. Detailed views 84 of the assembly groups are selected via selection of individually shown assembly groups in the overall view 72. In this graphical representation 84 of the assembly group then displayed, a further selection of subordinate assembly groups or structural elements is possible, similar to the selection of the assembly groups according to FIG. 3, in order to specify a further graphical representation of these subordinate assembly groups or the modular unit with further detailed information. As a graphical representation, schematic drawings are preferably output in which details of the printer nonessential for operation and control are not shown. However, these schematic drawings are sufficiently true to the original in order to enable a rapid identification of the assembly groups, structural elements and components actually present at the printer 12 with the displayed components.

Via these schematic drawings, it is also possible to display parts that, for example, were partially or entirely concealed by other parts in a photo. The schematic drawings are in particular technical drawings in two-dimensional and three-dimensional representation. Selection surfaces that can be selected with the aid of the pointing device and/or a touch-sensitive screen are preferably associated with the assembly groups and structural units shown in the schematic drawings. The operation and error states of individual assembly groups can be displayed via a colored identification of the respective assembly groups in the individual schematic representations. Thus, as already specified, assembly groups or structural elements that exhibit an error state are indicated in red; assembly groups that produce an alarm state are indicated in yellow; and assembly groups that have a normal operating state are indicated in green or are not indicated.

For very proficient service technicians and operating personnel, a faster selection of user interfaces is possible via the menu 66. However, the operating personnel or the service technicians receive further information about other assembly groups and structural elements of the printer in the successive following selections and displays of assembly groups and structural elements. The service technicians and operating personnel thus receive in particular that an error has occurred in further assembly groups, or that the further assembly groups exhibit no errors. However, if for individual structural units or assembly groups a great deal of detailed information exists that must be displayed after the selection of this structural unit or of the structural element, a graphical representation of the structural unit or of the structural element is foregone, and only the measurement and default values, as well as the operating states, are output.

As already explained in connection with FIGS. 1 and 2, the graphical user interface 62 is in particular generated with the aid of program elements that also control the access to default values, parameters and measurement values of the printer. The same program element to determine the default values of the printer 12 for display with the aid of the graphical user interface 62 can thereby also be used to transmit to the printer 12 the default values that were read out from the databank 52. In order to enable a clear representation of the structural units, a plurality of information is not immediately displayed with displays of the schematic representation of the structural units.

Individually shown elements of the structural unit are provided with sensitive surfaces 74, whereby upon sweeping over these surfaces with the cursor 76 further information is shown with the aid of a text field. The size and shape of the sensitive surfaces 74 are thereby preferably selected such that a plurality of structural elements, in particular sensors and actuators that form a functional group and are functionally connected, have a common sensitive surface 74, whereby the output information then comprises indications about the entire functional group. If the cursor 76 is positioned over such a sensitive surface 74, a display field with further information about the corresponding structural element or the functional group is output after a predetermined time, for example of three seconds. In this display field, current measurement values and default values are preferably displayed that pertain to the respective structural element and the respective functional group.

It is preferably additionally shown, with the aid of a graphical representation associated with the respective measurement value or default value, whether the current measurement value is located in an acceptable range, and in which section of the acceptable range the current measurement value is located. Unusual measurement values are thus visualized to an operating personnel and immediately catch the eye. The current measurement values, limit values and units are continuously, repeatedly read out from the printer, such that both the measurement values and the measurement units and the measurement ranges, as well as the tolerance limits, are displayed exactly.

Figure 5:
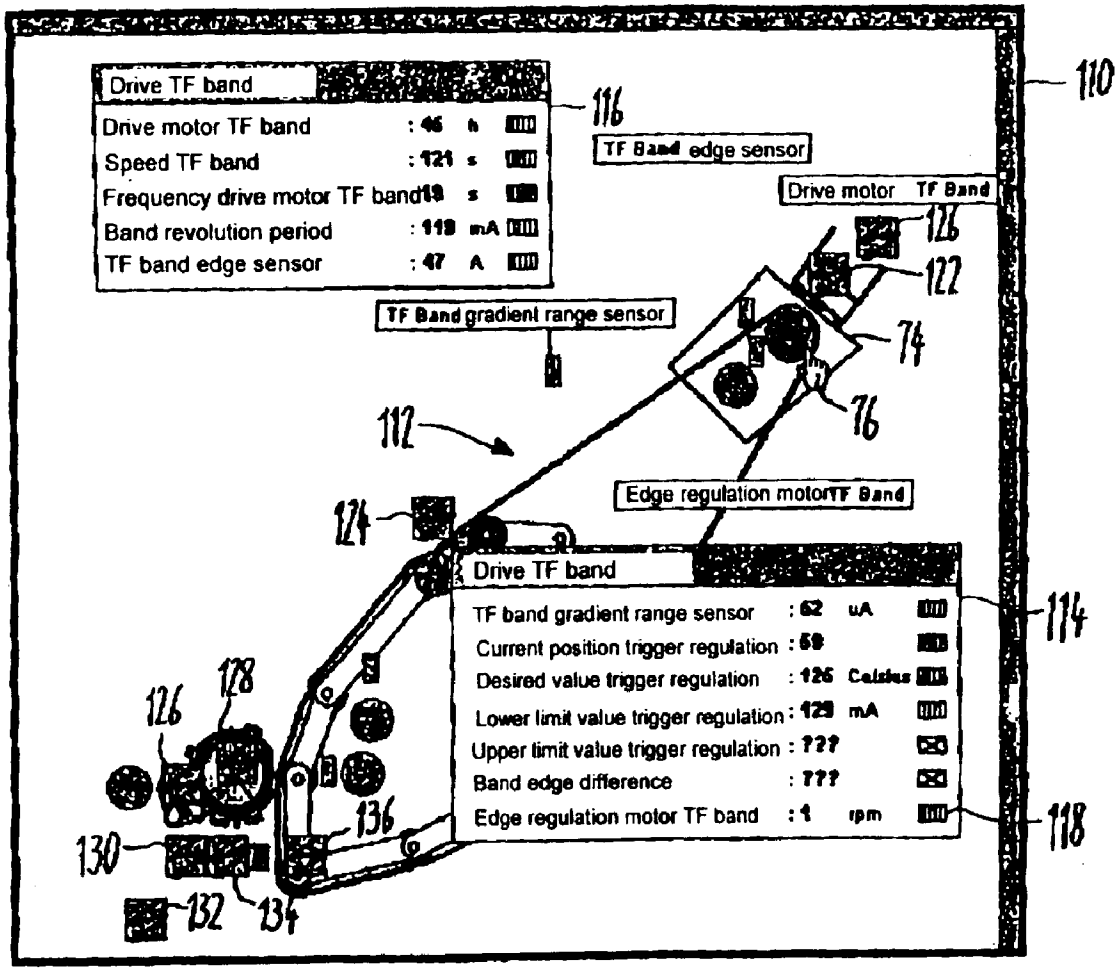
FIG. 5 illustrates a user interface with detailed information about a transfer band of the printer, whereby the user interface is shown in a section of the graphical user interface according to FIGS. 3 and 4.

An operating field 11 is shown in FIG. 5 with a schematic representation 112 of a band drive of a transfer band of the printer. The operating field 110 is displayed in the section 68 of the graphical user interface 62 after a selection via a corresponding menu item or via selection of the band drive unit with the aid of the schematic representation of a printer 12 according to FIG. 3. The user interface 110 comprises display fields 114, 116 in which detailed information is output with current measurement values and default values that in particular pertain to the actuation of the transfer band. The display fields 116 and 114 comprise graphic elements for display of the current measurement value in the measurement region, of which one is designated with 118. Furthermore, structural elements, in particular sensors and actuators, are indicated with graphical symbols 120 through 136, whereby alarm and error states of these structural elements are visualized. If a measurement value is outside of a measurement range of a sensor, the measurement value can not be determined, and in place of the number of the measurement value question marks are output in the display fields 114 and 116.

Figure 6:
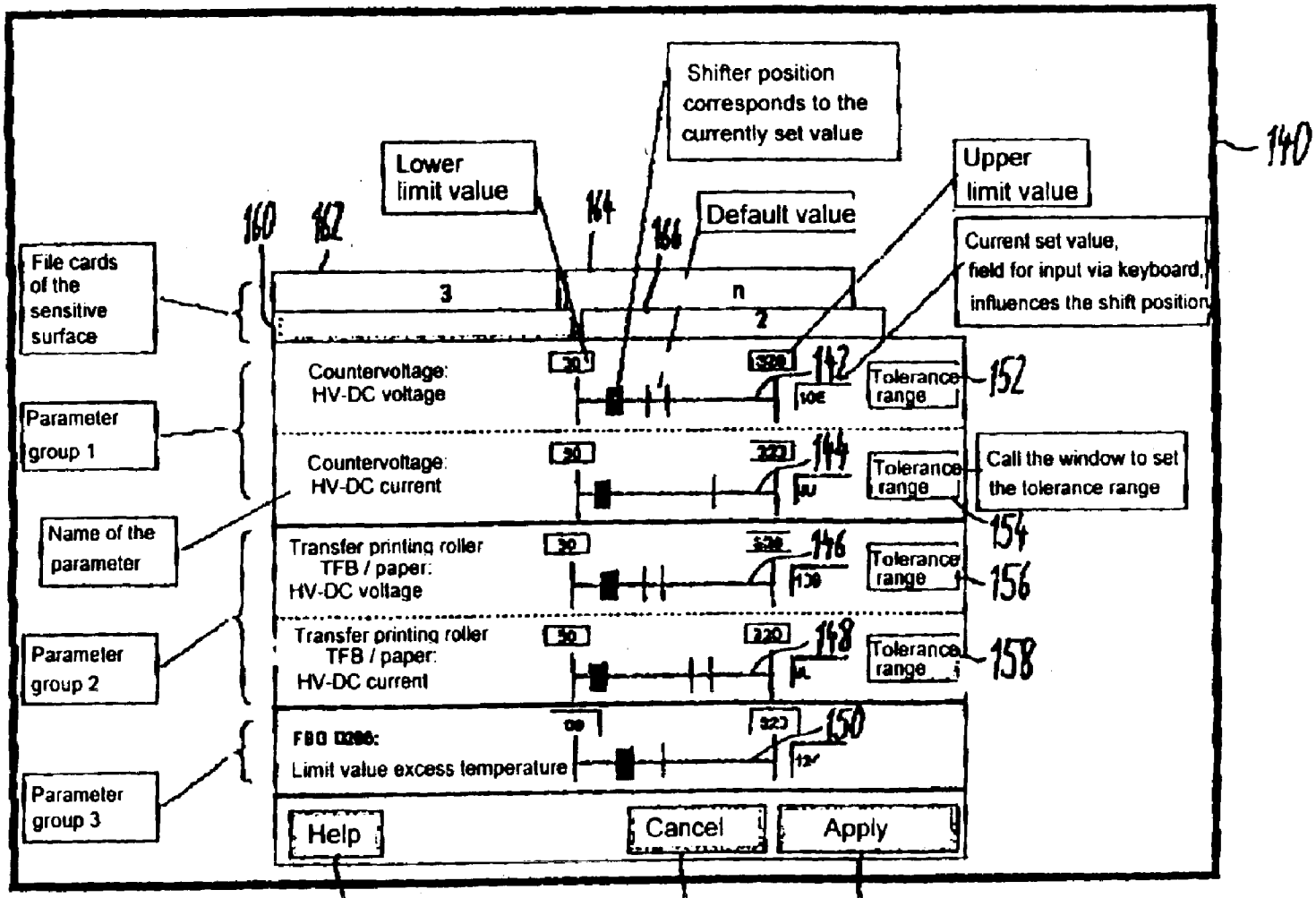
FIG. 6 shows a user interface to set voltages for transfer of toner material.

A user interface to input parameter values, in particular desired values, is shown in FIG. 6. Similar to the user interface 110 according to FIG. 5, the user interface 140 is shown in the section 68 of the graphical user interface 62. With the aid of the user interface 140, desired values are established for voltages and currents to be set. The graphical user interface 140 comprises graphical shift regulators 142 through 148 with which desired values can be set for voltage differences between an element of the printer and a reference potential or with regard to the potential, a paper web, as well as for currents to be set. The limit value for a temperature can be set with the aid of the shift regulator 150. The graphical shift regulators 142 through 150 respectively comprise at least one marking that specifies a base default value, what is known as a factory setting. With the aid of the graphical function keys 152 through 158 associated with the graphical shift regulators 142 through 148, further display fields can be called in which limit values can be set for alarm disconnection and error messages of the respective voltage or the respective current. A register or index card 160 is currently selected on which the shift regulators 142 through 150 already specified are shown, as well as the graphical function keys 152 through 158. To the left, next to the shift regulator a plain text specification is located of the parameter whose desired value is set with the aid of the graphical shift regulators 142 through 150. Via further register cards 162, 164, 166, further user interfaces can be displayed with graphical shift regulators and/or input and/or output fields.

At the beginning of the scale of each graphical shift regulator 142 through 115, the initial scale value and the end scale value of the setting range of the shift regulator are shown in the output fields. To the right, next to the respective shift regulator 142 through 150, an input and/or output field is respectively arranged in which the desired value respectively currently set on the shift regulator is output as a number value. With the aid of the respective input field, the current desired value can also be input via a keyboard of an operating unit on which the graphical user interface is shown with the user interface 140. The user interface 140 furthermore comprises graphical function keys 168, 170 and 172, whereby with the aid of the function key 168 a display field with help information is output via the graphical user interface 62. With the aid of the graphical function key 170, the currently implemented changes are discarded and the user interface 140 is quit. By activating the graphical function key 172, the currently implemented changed to the desired values are applied.

Although preferred exemplary embodiments are shown and specified in detail in the drawings and in the previous specification, this should be viewed as being purely exemplary, and the invention should not be viewed as limited. It is to be noted that only the preferred exemplary embodiments are shown and specified, and all changes and modifications that presently and in the future lie in the scope of protection of the invention should be protected.

We claim as our invention:

1. A method for simple operation, maintenance, or configuration of an electrophotographic printing or copying system, comprising the steps of:

with aid of an operating unit, outputting a graphical user interface with at least one first graphical representation of the printing or copying system;

selecting a displayed assembly group of the printing or copying system with aid of the first graphical representation;

via said selected displayed assembly group at least one item of information about the selected assembly group is output with aid of the graphical user interface; and reading out at least one item of the information from a data bank via a data interface.

2. The method according to claim 1 wherein the at least one item of information is output with aid of at least one of a second graphical representation of the printing or copying system, a table with at least one of measurement values and default values, and a text field.

3. The method according to claim 2 wherein the second graphical representation comprises a graphical representation of a selected structural unit that has been enlarged with regard to the first graphical representation.

4. The method according to claim 2 wherein at least the second graphical representation is a schematic drawing with error-relevant details of the printing or copying system.

5. The method according to claim 1 wherein at least one of an error notice and a warning notice is provided in at least one of the first and second graphical representations and that refers to at least one of a faulty assembly group and a faulty structural element.

6. The method according to claim 1 wherein the graphical user interface comprises a section in which all selectable graphical representations and user interfaces are comprised of menu items and are selectable via these menu items.

7. The method according to claim 1 wherein data are transmitted between the databank and the operating unit via a network connection.

8. A method for simple operation, maintenance, or configuration of an electrographic printing or copying system, comprising the steps of:

with aid of an operating unit, outputting a graphical user interface with at least one first graphical representation of the printing or copying system;

selecting a displayed assembly group of the printing or copying system with aid of the first graphical representation;

via said selected displayed assembly group at least one item of information about the selected assembly group is output with aid of the graphical user interface;

at least one of an error notice and a warning notice is provided in at least one of the first and second graphical representations in that it refers to at least one of a faulty assembly group and a faulty structural element; and the showing warning notice with aid of a yellow color, and showing the error notice with aid of a red color.

9. A method for configuring an electrophotographic printing or copying system, comprising the steps of:

providing a first data set and at least one second data set stored in a databank, the first data set comprising at least a value of a first default value and a second data set comprising at least a value of a second default value;

with aid of a first program element, reading out the value of the first default value and the value of the second default value from the databank with databank interrogation commands;

transmitting data with the value of the first default value and with the value of the second default value to a first data processing system of an operating unit of the printing or copying system, whereby the data are supplied to a second program element executed via the first data processing system;

transmitting the data to a second data processing system of the printing or copying system via a data connection with aid of the second program element; and transmitting the data to the second program element with aid of a platform-independent socket interface.

10. The method according to claim 9 wherein the databank queries are instructions of a query language that is supported by the databank.

11. The method according to claim 10 wherein the query language is SQL.

12. The method according to claim 9 wherein the databank instructions are comprised in a script that is created with aid of a scripting language, whereby the databank interrogation commands are implemented in succession.

13. The method according to claim 12 wherein the script is a Java script.

14. The method according to claim 12 wherein the script comprises a sequence of at least one of instructions and parameters.

15. The method according to claim 9 wherein at least one of the first and second data set comprises further information about at least one of a value range, measurement units, calculation factors, numerical values, and a plain text description of the default value, whereby a part of the information comprised in the data set is selected with aid of the databank interrogation command.

16. The method according to any of the claim 9 wherein the operating unit is a service and maintenance computer that is connected for at least one of operation, maintenance and configuration of the printing or copying system.

17. The method according to claim 9 wherein a transmission of the value of the first default value and the value of the second default value occurs between the first data processing system and the second data processing system with aid of a remote method invocation communication.

18. The method according to claim 9 wherein communication between the first program element and the second program element occurs with aid of a socket.

19. The method according to claim 9 wherein a first network connection is provided between the databank and the first data processing system, and a second network connection is provided between the first data processing system and the second data processing system.

20. The method according to claim 9 wherein the second program element is a signed JAVA applet that is executed with help of a JAVA runtime program environment of a browser program module executed by the first data processing system.

21. The method according to claim 9 wherein the values of the default values are stored in a database of the printing or copying system.

22. A system for configuring an electrophotographic printing or copying system, comprising:

a first data set and at least one second data set stored in a databank, the first data set comprising at least a value of a first default value and the second data set comprising at least a value of a second default value;

a first program element provided with databank interrogation commands and wherein given a processing of the commands the value of the first default value and the value of the second default value being read out from the databank;

the first data processing system executing a second program element to which the data are transmitted, the transmission of the data to the second program element occurring with aid of a platform-independent socket interface; and a data connection via which the data are transmitted from the first data processing system to a second data processing system of the printing or copying system with aid of the second program element.

23. The system according to claim 22 wherein a dialog serves to transmit data between the databank and the first data processing system and between the first data processing system and the second data processing system.

24. A method for control of an electrophotographic printing or copying system, comprising the steps of:

with the aid of an operating unit, outputting a graphical user interface with at least graphical representation of the printing or copying system, and another graphical representation of a selected structural unit which is an enlargement of a portion of the at least one graphical representation;

selecting a displayed assembly group of the printing or copying system with aid of the second graphical representation;

via said selected displayed assembly group at least one item of information about the selected assembly group is output with aid of the graphical user interface; and reading out at least one item of the information from a databank via a data interface.

25. A method for configuring an electrophotographic printing or copying system, comprising the steps of:

providing a first stored data set and at least one second stored dataset, the first data set comprising at least a value of a first default value and a second dataset comprising at least a value of a second default value;

with aid of a first program element, reading out the value of the first default value and the value of the second default value with interrogation commands;

transmitting data with the value of the first default value and with the value of the second default value to a first data processing system of an operating unit of the printing or copying system, whereby the data are supplied to a second program element executed via the first data processing system;

transmitting the data to a second data processing system of the printing or copying system via a data connection with aid of the second program element; and transmitting the data to the second program element.

* * * * *